US005195043A

United States Patent [19]

Varner

[11] Patent Number: 5,195,043

[45] Date of Patent: Mar. 16, 1993

[54] AUTOMATIC GENERATION OF LOOK-UP TABLES FOR REQUESTED PATTERNS AND COLORS

[75] Inventor: George C. Varner, Moore, S.C.

[73] Assignee: Milliken Research Corporation, Spartanburg, S.C.

[21] Appl. No.: 488,564

[22] Filed: Mar. 2, 1990

[51] Int. Cl.[5] ..... G06F 15/46

[52] U.S. Cl. ..... 364/410; 364/469; 68/205 R; 8/149; 239/69

[58] Field of Search ..... 364/369, 370; 68/205 R; 8/149, 151, 153; 239/61, 69; 427/288

[56] References Cited

U.S. PATENT DOCUMENTS

| | | | |
|---|---|---|---|
| 3,894,413 | 7/1975 | Johnson | 68/205 R |
| 4,033,154 | 7/1977 | Johnson | 68/205 R |
| 4,116,626 | 9/1978 | Varner | 8/149 |
| 4,170,883 | 10/1979 | Varner | 68/205 R |
| 4,545,086 | 10/1985 | Varner | 8/151 |
| 4,614,300 | 9/1986 | Falcoff | 239/71 |
| 4,984,169 | 1/1991 | Johnson, Jr. | 364/469 |

*Primary Examiner*—Robert W. Beausoliel
*Assistant Examiner*—Paul Gordon
*Attorney, Agent, or Firm*—Kevin M. Kercher; H. William Perry

[57] ABSTRACT

Method and apparatus for automatically loading at least one look-up table in a textile dyeing system with firing time data. The machine operator enters a list of entries including a base entry, machine color loading entries and a stock entry into the system. A firing time table of firing times is generated for each of a plurality of color bars with respect to a given base, from the base entry. A machine color table of color data is generated for each of the plurality of color bars from the machine color loading entires and a pattern color table of pixel codes and their associated colors with respect to a given pattern is generated from the stock entry. The system correlates the firing times, color data and pixel codes to obtain a modified firing time for each pixel code for each color bar and loads the look-up table with the modified firing time data.

29 Claims, 6 Drawing Sheets

BASE WXYZ

| BAR | FT |
|---|---|
| 1 | 10 |
| 2 | 10 |
| 3 | 20 |
| 4 | 15 |

FIG. -6A-

MACHINE CONFIG.

| COLOR | BAR |
|---|---|
| RED | 1 |
| BLUE | 2 |
| GREEN | 3 |
| YELLOW | 4 |

FIG. -6B-

SKU ABC

| CODE | COLOR |
|---|---|
| A | RED |
| B | BLUE |

FIG. -6C-

LUT'S

| CODES | 1 | 2 | 3 | 4 |
|---|---|---|---|---|
| A | 10MS | 0 | 0 | 0 |
| B | 0 | 10MS | 0 | 0 |

FIG. -6D-

LUT'S

| | 1 | 2 | 3 | 4 |
|---|---|---|---|---|
| A | 5MS | 5MS | 0 | 0 |
| C | 0 | 0 | 20MS | 0 |

FIG. -7D-

LUT'S

| | 1 | 2 | 3 | 4 |
|---|---|---|---|---|
| A | 0 | 0 | 20MS | 0 |
| B | 0 | 10MS | 0 | 0 |
| C | 5MS | 2.5MS | 0 | 3.75MS |

FIG. -7E-

LUT'S

| | 1 | 2 | 3 | 4 | 5 |
|---|---|---|---|---|---|
| A | 0 | 0 | 0 | 0 | 10MS |
| B | 0 | 10MS | 0 | 0 | 0 |

FIG. -7F-

BASE WXYZ

| BAR | FT |
|---|---|
| 1 | 10 |
| 2 | 10 |
| 3 | 20 |
| 4 | 15 |

FIG. -7A-

MACHINE CONFIG.

| COLOR | BAR |
|---|---|
| RED | 1 |
| BLUE | 2 |
| GREEN | 3 |
| YELLOW | 4 |

FIG. -7B-

SKU ADE

| CODE | COLOR |
|---|---|
| A | 50% RED, 50% BLUE |
| C | GREEN |

FIG. -7C-

AUTOMATIC GENERATION OF LOOK-UP TABLES FOR REQUESTED PATTERNS AND COLORS

FIELD OF THE INVENTION

This invention relates to the automatic generation of look-up tables used in a textile dyeing apparatus and, more particularly, to the generation of look-up tables in response to a requested pattern, color combination and given apparatus configuration.

BACKGROUND OF THE INVENTION

Generally, textile dyeing systems include several arrays or "color bars" comprised of individually controllable and addressable dye jets that are arranged in spaced, parallel relation generally above and across the path of a moving web of substrate. For a given desired pattern, each color bar is associated with a single color of dye.

A stream of dye, directed at the moving substrate, continuously flows from a plurality of dye jets in each color bar. Positioned along the path of each dye stream is an individual, transversely directed stream of air capable of intersecting and diverting the respective individual dye stream into a catch basin. Each such diverting air stream is associated with a valve which is capable of interrupting the flow of air in accordance with internally supplied pattern data. Accordingly, each of the diverting streams of air may be interrupted in accordance with such pattern data and thereby initiate the flow of dye onto the substrate from the various respective dye jet locations along the length of the color bar. For purposes of discussion, referring to a dye jet as being "on" or "off" in the context of the patterning methods an apparatus described in detail herein merely refers, respectively, to whether the continuously flowing dye jet is being allowed to strike, or is being prevented from striking, the substrate.

In the dyeing apparatus generally described above, up to eight color bars, each assigned to a different color dye or other patterning agent, are sometimes necessary to generate a pattern having the desired color variety and blending. Additionally, each color bar may have hundreds or thousands of individually controllable dye jets in order to generate a pattern having the desired complexity and lateral pattern resolution.

In connection with such dyeing systems it has been found necessary to develop electronic processing and control systems for the purpose of processing each "job" of patterns to be generated on the substrate by transforming the raw source pattern data associated with each job into air valve actuating commands. The processing and control system further distributes these commands to the appropriate air valves at the appropriate time. Such electronic processing systems can be of a multiprocessor system including a host computer and a real-time computer. The real-time computer receives the raw source pattern data and forwards the data to the control system associated with the dyeing apparatus.

In these systems, the raw pattern data must first be converted to "on/off" firing instructions. The control system accepts the raw source pattern data in the form of a series of pixel codes. The pixel codes define those distinct areas of the pattern which may be assigned a distinguishing color. Each code specifies, for each pattern line, the dye jet response for a given dye jet position on each and every array. In a system having eight color bars, each pixel code therefore controls the response of eight separate dye jets (one per color bar) with respect to a single pattern line. The term "pattern line", as used herein, is intended to describe a continuous line of single pattern elements extending across the substrate parallel to the patterning color bars. Such pattern lines have a thickness, measured in the direction of substrate travel, equal to the maximum permitted amount of substrate travel under the patterning color bars between color bar pattern data updates. The term "pattern element", as used herein, is intended to be analogous to the term "pixel" as that term is used in the field of electronic imaging.

An operator's interface, such as a workstation terminal, may be coupled to the host computer in the multiprocessor system. The workstation serves as the operator's interface for providing the input parameters to the host computer for each job of patterns to be generated on the substrate of the textile dyeing apparatus.

The operator enters the input parameters as a "RUN LIST" which designates the type of substrate to be dyed and the types of patterns to be printed for each job. The RUN LIST input, for the type of base to be dyed, accesses a base file which includes the firing time for each of the color bars in the dyeing apparatus. The RUN LIST entry, for the type of pattern, accesses a stock keeping unit (SKU) file. The SKU file designates for each pixel code used in the pattern, the respective color bars associated therewith. With this information, the multiprocessor and control systems generate the individual firing instructions for each jet in each color bar.

A known apparatus, described in commonly assigned U.S. Pat. No. 4,033,154, demultiplexes and distributes the sequence of pixel codes to a plurality of color bars, each color bar being comprised of multiple dye jets. The apparatus makes use of manually operable thumb wheel settings, associated with each color bar, to determine the time period during which each of the dye jets in the color bar is allowed to fire in response to a firing instruction, i.e., the "firing time". In this system, the operator inputs in the RUN LIST the color bars associated with each pixel code. The system then generates a converted pattern of firing time instructions from the raw source pattern data.

For example, a sequence of pixel codes for a single pattern line may be "AABAB", where pixel code A produces a red color and pixel code B produces a blue color. The operator inputs the "color loading" of the machine into the system, i.e., which color bars contain which colors. For example, if color bar "1" contains the red dye and color bar 2 contains the blue dye, then the operator associates pixel code A with color bar 1 and pixel code B with color bar 2 in the RUN LIST. From this information, the pixel codes for each pattern line are converted into on/off firing instructions for each color bar. In this example, the sequence of pixel codes "AABAB" would generate the following firing instructions for the jets in color bar 1: On, On, Off, On, Off. For color bar 2, the same sequence of pixel codes are converted to the following firing instructions: Off, Off, On, Off, On. The firing instructions are then stored in memory for the respective pattern. Once the pattern is ready to be run on the machine, the converted firing instructions are sent to the color bars, in accordance with the substrate travel beneath the color bars, for dyeing the substrate.

Because of the thumbwheel settings, the period of time during which any of the dye streams associated with a dye jet in a given color bar may be allowed to strike the substrate must be the same for all dye streams in the color bar, i.e., this control system is incapable of allowing one dye stream to dispense dye onto the substrate for a different period of time than another dye stream in the same color bar. Further, when changing patterns, the only means for varying the color bar firing time is to manually change the thumbwheel settings. This presents a problem when the operator is running a sequence of jobs in the RUN LIST because it is not possible to change the firing time thumbwheel settings for a respective color bar quickly or precisely enough to avoid wasting the substrate material traveling beneath the color bars.

A further problem with the above system is that the converted firing instructions require a tremendous amount of storage space. Thus, only a limited number of patterns can practicably be stored in the system.

Another known system converts the raw source pattern data to firing instructions by electronically associating the source pattern data with pre-generated firing instruction data from a look-up table. The operator's RUN LIST includes the SKU number and the base number. As noted above, the SKU file designates the appropriate color bars for each pixel code. The operator thus loads the color bar with the appropriate colored dye as determined by the SKU file. A separate look-up table is maintained for each color bar in the dyeing apparatus.

In the operation of this system, for example, a sequence of pixel codes "AABBAA" are each individually associated with a particular address in the look-up table. For this simple example, the patterns SKU file would designate pixel code A equaling color bar 1 and pixel code B equaling color bar 2. The operator then must load color bar 1 with the appropriate color for pixel code A and color bar 2 with the color for pixel code B. The following look-up tables are used wherein "FT" designates a firing time:

| | LUT's | |
|---|---|---|
| | BAR 1 | BAR 2 |
| A | FT | 0 |
| B | 0 | FT |

Each pixel code in the sequence has an associated firing time instruction in the look-up table for each color bar. These instructions are fed to memories associated with each color bar. In this example, the memory associated with color bar 1 receives the following sequence of firing instructions: FT, FT, Off, Off, FT, FT. The memory associated with color bar 2 receives the following set of firing instructions: Off, Off, FT, FT, Off, Off. Thus, the look-up table translates the raw source pattern data into firing time data in accordance with the machine set up. Each time a new pattern, identified by a new SKU number and associated file, is to be run on the machine, a new look-up table must be generated for the pattern. This presents a problem due to the dye color loading in the color bars of the apparatus. If a second pattern requires different colors to be loaded into the color bars, as specified by the pixel code/color bar associations in the SKU file, then the machine must be shut down to reload the color bars. This is a time and labor intensive process involving cleaning out the color bars and reloading them with the appropriate colors.

Alternatively, if different colors, required by the second pattern, are loaded in other color bars in the apparatus, then the SKU file will need updating due to the pixel code/color bar association in the SKU file. There is therefore needed a textile dyeing apparatus and associated processing and control system which can operate in real-time the patterns input into the system from the operator's RUN LIST.

SUMMARY OF THE INVENTION

The present invention overcomes these problems by the automatic, computer generation of look-up tables in response to the requested pattern, color combination and machine configuration. The system produces the look-up tables from the operator's RUN LIST in a four phase operation.

First, the type of RUN LIST entry is determined and an appropriate table generated to store its information. If an entry is a Base entry, then a firing time table is generated for the particular substrate associated with the Base entry. If the entry is determined to be a Color entry, the second phase of operation generates a machine color table for the color loading configuration. If the entry is an SKU entry, then the third phase generates a pattern color table including the information from the respective SKU file identified by the SKU entry. The pattern color table associates each pixel code with a particular color name rather than a fixed color bar in the jet dying apparatus as previously was done. Thus, for example, the pixel code A is associated with a color name such as "red" rather than a particular color bar.

The fourth phase of operation generates the look-up tables from the data provided in the firing time table, machine color table and pattern color table. In this system, the operator only needs to input the color entries for the machine color loading configuration to correctly generate the proper look-up tables for the requested pattern and substrate.

It is an advantage of the present invention to reduce the amount of storage space necessary by eliminating the need for storing converted firing instructions. Further, a series of jobs can be continuously printed without requiring machine "down" time previously necessary to clean and reload a particular color bar. The present invention further allows the operator to randomly load the colors into the machine's color bars irrespective of the patterns to be run. The system software automatically generates the correct look-up tables for the particular machine configuration.

Details of the present invention herein, as well as additional advantages and distinguishing features, will be better understood with reference to the following figures:

BRIEF DESCRIPTION OF THE DRAWINGS

FIGS. 6A–6D illustrate a firing time table, machine color table, pattern color table and look-up tables, respectively, for an example of the present invention.

FIGS. 7A–7F illustrate further examples of the present invention.

DETAILED DESCRIPTION

Figure 1:
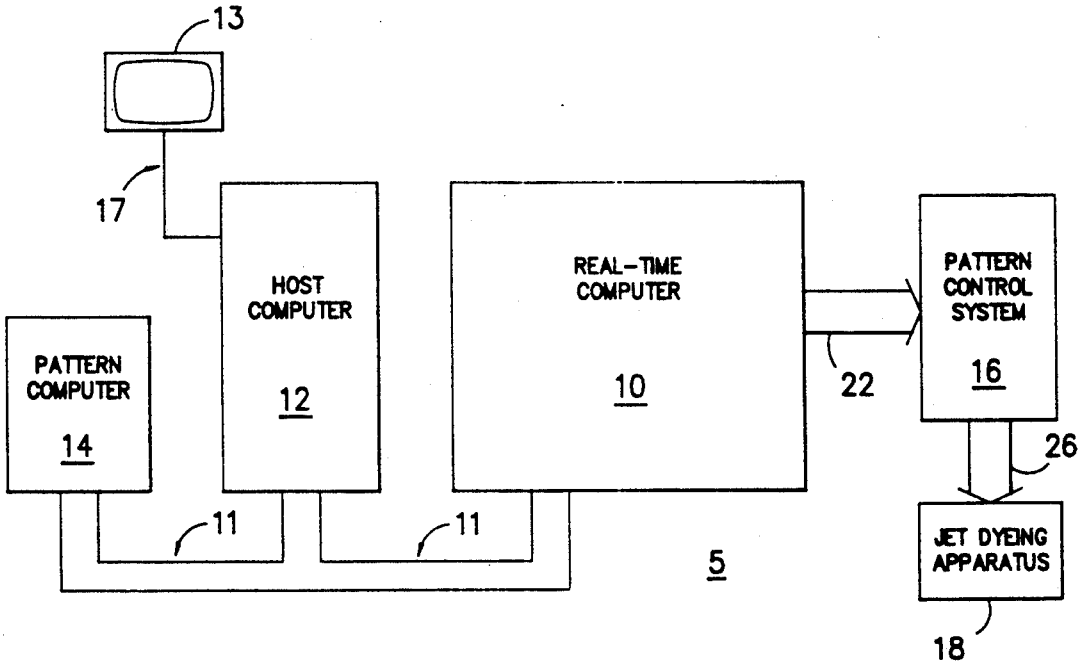
FIG. 1 is a block diagram illustrating a multiprocessor and pattern control system environment in which the present invention may operate.

Referring to FIG. 1, the multiprocessor patterning system 5 is shown having a host computer 12 coupled via a bus 11 to a real-time computer 10. Optional pattern computer 14 is further coupled to the host computer 12 and real-time computer 10 by the bus 11. It is readily apparent that the coupling of the pattern computer 14, host computer 12 and real-time computer 10 may be by any means for coupling a local area network (LAN) such as an Ethernet bus.

A pattern control system 16 is coupled via bus 26 to a jet dyeing apparatus 18. The jet dyeing apparatus 18 is described in greater detail in FIGS. 2 and 3. The pattern control system 16 receives input data over bus 22 from the real-time computer 10.

Optional pattern computer 14 may be provided to allow a user of the system to quickly create their own pattern design. Alternatively, pattern designs may be pre-loaded onto magnetic or optical media for reading into the system. Each design has an associated stock keeping unit (SKU) file for providing the set-up parameters for the system for each pattern.

An SKU file includes the pattern name for the pattern to be printed, the associated color names for each pixel code in the pattern, and a base reference ID identifying the substrate on which the pattern is to be printed.

The base reference ID accesses a base file containing the firing times for each color bar in the jet dyeing apparatus 18 for that particular substrate. A simplified example of an SKU file for several patterns and a Base file are given below in Tables A and B. In this example, only two pixel codes, A and B, are used in the designated pattern. It is readily apparent however, that any number of pixel codes can be provided in a pattern. Further, only four colors are used such that the Base file provides firing times for each of the four color bars.

TABLE A

| SKU FILE | |
|---|---|
| SKU | ABC |
| Pixel Code A | = RED |
| Pixel Code B | = BLUE |
| Base Reference | = WXYZ |
| SKU | ADE |
| Pixel Code A | = 50% RED, 50% BLUE |
| Pixel Code C | = GREEN |
| SKU | CDF |
| Pixel Code A | = GREEN |
| Pixel Code B | = BLUE |
| Pixel Code C | = 25% YELLOW, 50% RED, 25% BLUE |

TABLE B

| BASE FILE | |
|---|---|
| BASE | WXYZ |
| COLOR BAR 1 | = 10 ms |
| COLOR BAR 2 | = 10 ms |
| COLOR BAR 3 | = 20 ms |

TABLE B-continued

| BASE FILE |
|---|
| COLOR BAR 4 = 15 ms |

Referring back to FIG. 1, a computer terminal 13 may be coupled via a suitable connection 17, e.g., a standard RS232 cable, to the host computer 12. The terminal 13 then serves as the operator's interface for providing input parameters in the form of a RUN LIST to the host computer 12 for each job or series of jobs to be generated on the substrate by jet dyeing apparatus 18. The RUN LIST is simply a series of instructions provided to the host computer 12 for retrieving the SKU file and base file for printing a requested pattern. The RUN LIST further includes the machine set-up or "color loading" for each of the color bars in the jet dyeing apparatus 18. An example of a typical RUN LIST is given below in Table C wherein the SKU files are identified by a three-character code and the Base file is identified by a four-character code.

TABLE C

| OPERATOR'S RUN LIST | |
|---|---|
| BASE | = WXYZ |
| COLOR BAR 1 | = RED |
| COLOR BAR 2 | = BLUE |
| COLOR BAR 3 | = GREEN |
| COLOR BAR 4 | = YELLOW |
| SKU | = ABC |
| SKU | = ADE |
| SKU | = CDF |

The host computer 12 fetches the pattern data from the pattern computer 14 or other storage source (not shown) and sets it up for processing by the real-time computer 10. The real-time computer 10 functions to ensure that the raw source pattern data is properly output to the pattern control system 16 and hence provided to the individual jets in the jet dyeing apparatus 18.

Figure 2:
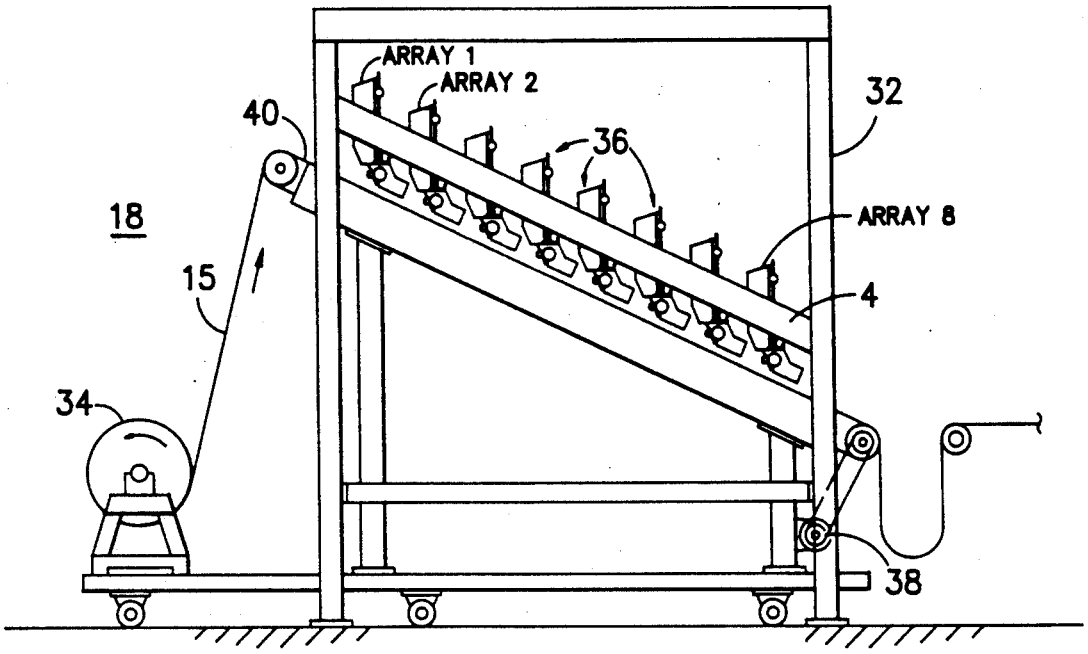
FIG. 2 is a diagrammatic side elevation view of a jet dyeing apparatus to which the present invention is particularly well adapted.

FIG. 2 shows a jet dyeing apparatus 18 comprised of a set of eight individual color bars 36 positioned within frame 32. Each color bar 36 is comprised of a plurality of dye jets, perhaps several hundred in number, arranged in spaced alignment along the length of the color bar, which color bar extends across the width of substrate 15. Substrate 15, such as a textile fabric, is supplied from roll 34 as transported through frame 32 and thereby under each color bar 36 by conveyor 40 driven by a motor indicated generally at 38. After being transported under color bars 36, substrate 15 may be passed through other dyeing-related colors steps such as drying, fixing, etc.

Figure 3:
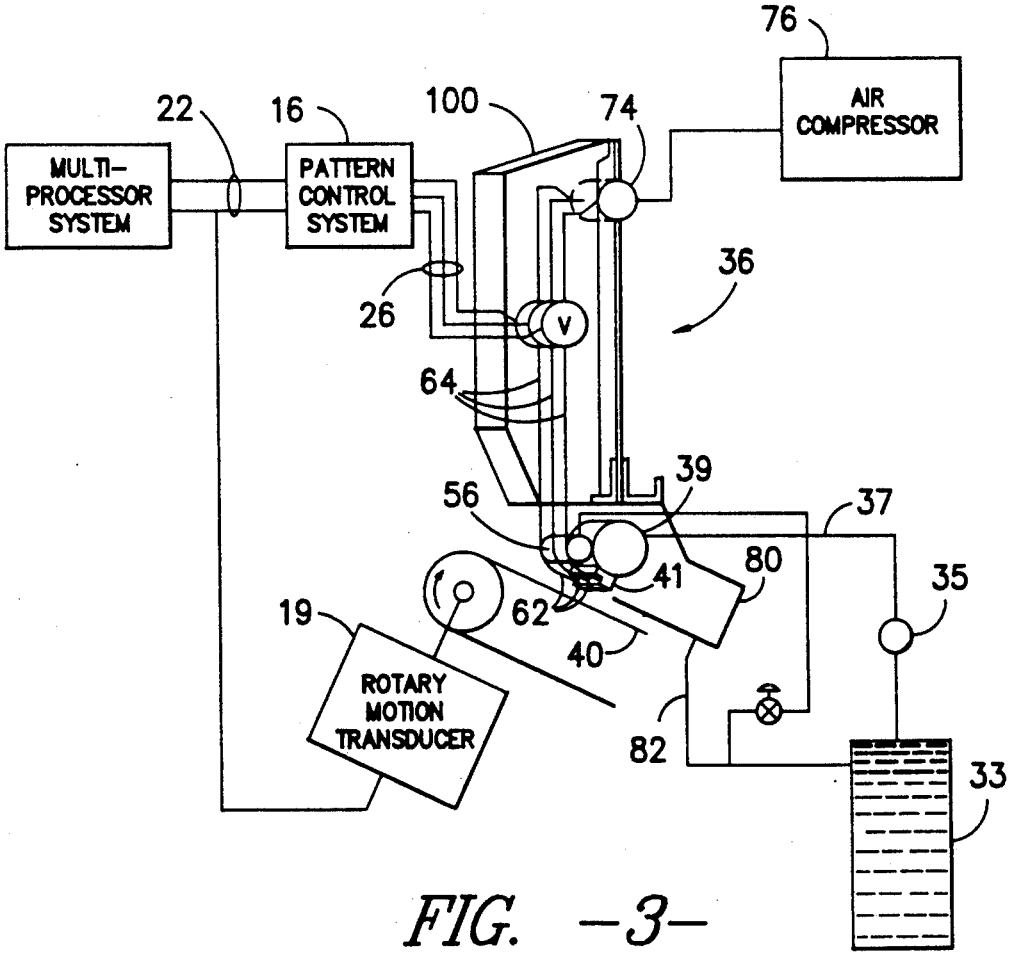
FIG. 3 is a schematic side elevation view of the apparatus of FIG. 2, showing only a single dye jet color bar and its operative connection to a liquid dye supply system as well as several electronic subsystems associated with the apparatus.

Referring to FIG. 3, there is shown in schematic form a side elevation of one color bar 36 comprising the jet dyeing apparatus 18 of FIG. 2. For each such color bar 36, a separate dye reservoir tank 33 supplies liquid dye under pressure by means of pump 35 and dye supply conduit means 37, to a primary dye manifold assembly 39 of the color bar 36. Primary manifold assembly 39 communicates with and supplies dye to dye sub-manifold assembly 41 at suitable locations along their respective lengths. Both manifold assembly 39 and sub-manifold assembly 41 extend across the width of conveyor 40 on which the substrate to be dyed is transported. Sub-manifold assembly 40 is provided with a plurality of spaced, generally downwardly directed dye passage outlets positioned across the width of conveyor 40 which produce a plurality of parallel dye streams which are directed onto the substrate surface to be patterned.

Positioned in alignment with and approximately perpendicular to each dye passage outlet (not shown) in sub-manifold assembly 41 is the outlet of an air deflection tube 62. Each tube 62 communicates by way of an air deflection conduit 64 with an individual electropneumatic valve, illustrated collectively at "V", which valve selectively interrupts the flow of air to air tube 62 in accordance with the pattern information supplied by pattern control system 16. Each valve is, in turn, connected by an air supply conduit to a pressurized air supply manifold 74 which is provided with pressurized air by air compressor 76. Each of the valves V, which may be, for example, of the electromagnetic solenoid type, are individually controlled by electrical signals received over bus 26 from the electronic pattern control system 16. The outlets of deflection tubes 62 direct streams of air which are aligned with and impinge against the continuously flowing streams of dye flowing from downwardly directed dye passages within sub-manifold 41 and deflect such streams into a primary collection chamber or trough 80, from which liquid dye is removed, by means of a suitable dye collection conduit 82, to dye reservoir tank 33 for recirculation.

The pattern control system 16 receives pattern data over bus 22 from the multiprocessor system described in FIG. 1. Desired pattern information from control system 16 is transmitted to the solenoid valves of each color bar 36 at appropriate times in response to movement of the substrate under the color bars by conveyor 40, which movement is detected by suitable rotary motion sensor or transducer means 19 operatively associated with the conveyor 40 and connected to control system 16.

Figure 4:
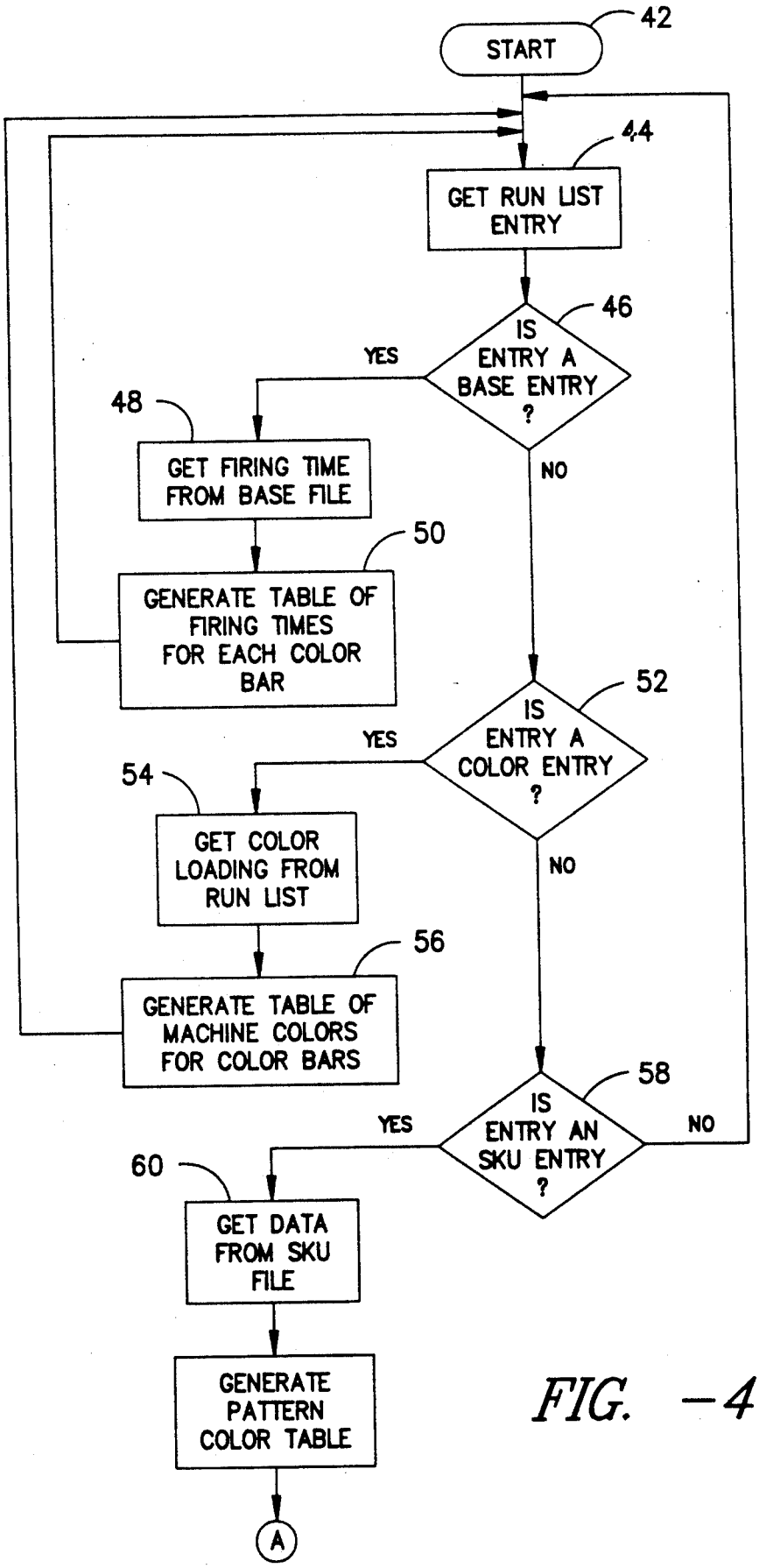
FIG. 4 is a flow chart describing the operation of the present invention.

Referring to FIG. 4 there is shown a flow chart illustrating the software operation for automatically generating the look-up tables associated with each color bar for each requested pattern. The system makes use of the RUN LIST generated by the operator at terminal 13 for producing the look-up tables for the requested pattern in the requested color combination. The system operates in four phases, the first three phases retrieve the file information and the machine color loading configuration necessary to produce the look-up tables for the requested pattern and the fourth phase actually generates the look-up tables to be used.

The machine operator need only input in his RUN LIST (1)which color bars contain which color, i.e., the color bar machine configuration loading, (2) what carpet base is being run, e.g., Base WXYZ, Base HIJK, etc. and (3) the requested pattern, e.g., SKU=ABC, ADE, CDF, etc. As shown in FIG. 4, the software system starts 42 by obtaining a RUN LIST entry 44 from the operator's RUN LIST.

Next, the system determines the type of RUN LIST entry, i.e., Base entry, color entry, or SKU entry as indicated by steps 46, 52 and 58. If the RUN LIST entry is a Base entry, then the system retrieves the Base file for that entry and obtains the firing times for each color bar for the respective substrate base as shown in step 48. From the firing times, the system generates a firing time table for each color bar in the jet dyeing apparatus at step 50. Once the firing time table has been generated, the system loops back to retrieve the next RUN LIST entry.

If the RUN LIST entry is a color entry, then the system obtains the color loading indicated by the RUN LIST (step 54). The machine configuration color loading is determined by the operator depending upon which colors are loaded into the respective dye tanks 33 (FIG. 3) for each color bar 36 in the jet dyeing apparatus 18. From the color loading, a table of machine colors for the color bars is generated, as indicated by step 56, and the system then loops to obtain the next RUN LIST entry.

If the RUN LIST entry is an SKU entry, then the system obtains the data from the SKU file, stored elsewhere in the system, such as in the pattern computer 14 (FIG. 1) or optical disk storage (not shown). From the SKU file, a pattern color table is generated, step 61, containing the colors associated with each pixel code in the pattern. Once the firing time table, machine color table, and pattern color table have been generated for a respective job, then the final phase of actually generating the look-up table is performed as shown in the flow chart of FIG. 5.

The system automatically generates the look-up tables for each color bar for the respective pattern, step 66, by first obtaining a first pixel code from the pattern color table, as indicated at step 68. Next, at step 70, using the pixel code previously obtained, the first color and percent of color from the pattern color table are obtained. Using the color, the system next gets the color bar number associated with that color from the machine color table, step 72. From the color bar number, the system obtains the firing time for the respective color bar from the firing time table as indicated by step 78. At step 84, a modified firing time is obtained by multiplying the percent of color, obtained in step 70, and the firing time obtained in step 78. The modified firing time is then stored in the look-up table for the given pixel code and color bar number as indicated by step 86.

The system then determines whether all colors for the particular pixel code have been found, step 88. If not, the system loops back to step 70 wherein the next color and percent of color are obtained from the pattern color table for the particular pixel code. This loop, steps 70–88, continues to repeat until all of the colors for the particular pixel code have been found.

At this point, the system determines whether all pixel codes have been loaded into the look-up table. If not, the system reverts to step 68 wherein the next pixel code is obtained from the pattern color table. The steps 68–90 then continue to loop until all pixel codes have been loaded into the look-up table. At this point, the entire look-up table for the requested pattern has been generated and is sent to the jet dyeing apparatus (step 92) before completing (step 94).

Figure 5:
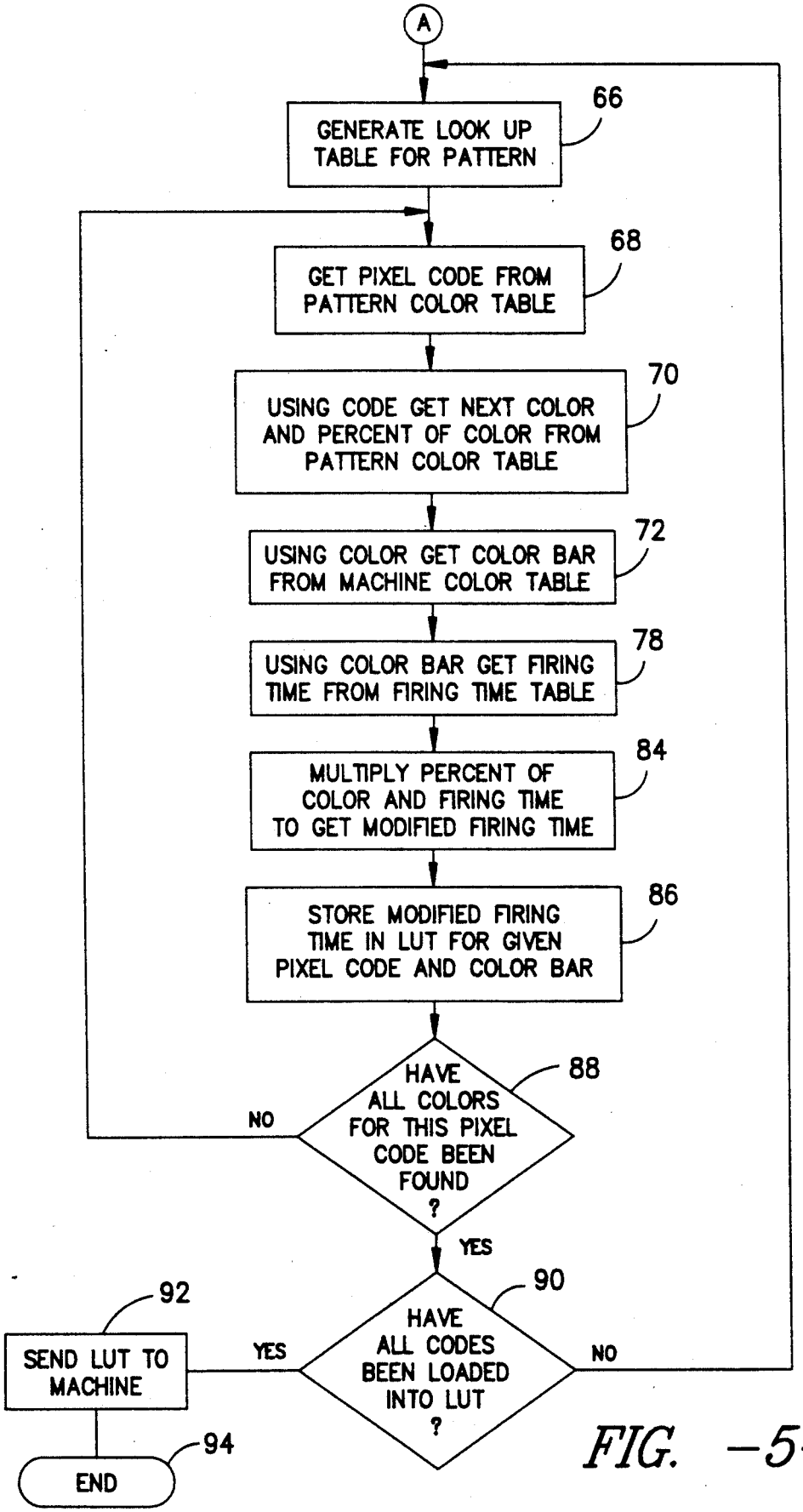
FIG. 5 is a flow chart describing the operation of the present invention.

The system software depicted by the flow charts shown in FIGS. 4 and 5 repeats itself each time new look-up tables are required. This may occur due to a change in the pattern to be printed, a change in the substrate or base upon which the pattern is to be printed or when the machine is configured differently. In this respect, it may be necessary to reconfigure the machine due to a malfunction of one or more of the color bars. For example, if the apparatus includes eight color bars, and only two colors are necessary for the pattern, if one of the color bars malfunctions, then that color can be loaded into one of the remaining six color bars and new look-up tables can be generated to still print the desired pattern.

A simplified series of examples are described below to illustrate the operation of the present invention. For purposes of illustration, a jet dyeing apparatus 18 is assumed to contain four color bars. Further, the SKU files and Base files are as given above in Tables A and B. The exemplary operator's RUN LIST, given in Table C above, will be used to process the jobs for SKU files ABC, ADE and CDF.

In operation, the first RUN LIST entry "Base=WXYZ" is obtained (step 44). The system determines that the entry is a Base entry and obtains the firing times for Base WXYZ from the Base file (step 48). The system then generates the firing time table for each color bar as shown in FIG. 6A wherein the firing times are given in milliseconds (ms).

The next RUN LIST entry, "Color Bar 1=red", is obtained and it is determined that it is for a color entry (step 52). The system obtains the color loading from the RUN LIST and generates the table of machine colors for the color bars as shown in FIG. 6B. Each of the color entries in the RUN LIST is obtained to complete the machine color table.

The system then obtains the next RUN LIST entry, "SKU=ABC", and obtains the corresponding data from the respective SKU file (step 60). From the SKU data, the pattern color table shown in FIG. 6C is obtained.

At this point, the system begins generating the actual look-up table for the requested pattern identified by SKU ABC. The first pixel code A and its associated color, red, are obtained from the pattern color table. Next, the system identifies the color red with color bar 1 from the machine color table. Finally, the firing time for color bar 1 is obtained from the firing time table. Thus, in our example, a firing time of 10 ms, associated with color bar 1, is stored in the look-up table shown in FIG. 6D for the respective pixel code A.

The system then repeats itself for pixel code B resulting in the storage of a 10 ms firing time for color bar 2 in the look-up table. Any look-up entry not filled by the system is assumed to contain a zero firing time or "null" firing time. Thus, the system generates the look-up tables shown in FIG. 6D for the requested pattern ABC.

Continuing the example, the next RUN LIST entry "SKU=ADE" is obtained from the operator's RUN LIST. This indicates a new pattern is requested and, in all likelihood, new look-up tables would need to be generated. Tables 7A–7C indicate the firing time table, machine color table and pattern color table, respectively, associated with SKU ADE. For this example, the firing time table shown in FIG. 7A is identical to the previous example as the same Base WXYZ is being run through the apparatus. Similarly, the machine color table remains the same as none of the color bar color loadings have been changed. The pattern color table, however, differs from the preceding example because a new pattern, SKU ADE is being run. As shown in FIG. 7C and the SKU file associated with the pattern ADE, for pixel code A, the associated colors include 50% red and 50% blue. Thus, when generating the look-up table entries, steps 70–88 of FIG. 5 would loop twice, i.e., once for 50% red and a second time for the next color, 50% blue.

In this example, the look-up tables shown in FIG. 7*d* are generated by the system. Pixel code A is first obtained from the pattern color table and its first color and percent of color, 50% red, are obtained (step 70). Next, the system associates the color red with color bar number 1 and then obtains the firing time of 10 milliseconds for that color bar from the firing time table. This firing time, 10 milliseconds, is multiplied by the percent of the color to obtain the modified firing time. Thus, 10 milliseconds times 50% equals 5 milliseconds which is then stored in the look-up table for the given pixel code and color bar.

Because all colors for this pixel code have not yet been found, the system loops back to step 70 (FIG. 5) and obtains the next color, i.e., 50% blue. This sequence of steps, 70–88, are repeated and the modified firing time stored in the look-up table (FIG. 7*d*). The operation then repeats for the remaining pixel codes in the pattern color table until the look-up tables are completed. It is apparent that by using percentages of colors, the colors can be shaded or blended to form other colors which are not loaded in the jet dying apparatus.

Returning to the operator's RUN LIST, the next entry "SKU=CDF" is obtained and the look-up tables of FIG. 7E are generated in accordance with the examples set forth above.

As shown above, the system automatically generates the look-up tables in response to the operators RUN LIST. The operator only needs to input the type of base to be run, the SKU pattern requested, and the machine configuration. The system then generates the look-up tables without any costly time delays for reloading colors in the color bars. Further, if one of the color bars malfunctions, the operator can still possibly finish the RUN LIST without any delays. For example, assuming a five color bar machine wherein only four of the color bars have been previously loaded as in the above examples. If, while preparing to run the pattern given by SKU ABC, the machine malfunctions and bar 1 is no longer operative, then the operator can quickly load color bar 5 with the red color dye and the system will automatically generate new look-up tables in response thereto. (It is assumed the Base ID specifies a 10 ms firing time for color bar 5.) In this example, the look-up tables shown in FIG. 7F would be generated as opposed to the look-up tables shown in FIG. 6D for a non-malfunctioning system. In either event, the correct pattern having the correct colors would be printed.

What is claimed is:

1. A method for automatically loading at least one look-up table in a textile dyeing system with firing time data, the method comprising the steps of:

a) entering a list of entries including entry, machine color loading entries and a stock entry into the system;

b) generating a firing time table of firing times, for each of a plurality of color bars with respect to a given base, from the base entry;

c) generating a machine color table of color data for each of the plurality of color bars from the machine color loading entries;

d) generating a pattern color table of pixel codes and their associated colors with respect to a given pattern from the stock entry;

e) correlating said firing times, color data and pixel codes to obtain a modified firing time for each pixel code for each color bar; and f) loading said look-up table with the modified firing time data for each pixel code for each color bar.

2. A method according to claim 1 wherein the step of correlating comprises the steps of:

a) obtaining a pixel code from the pattern color table;

b) associating said pixel code with a color and percent of color from the pattern color table;

c) obtaining a color bar associated with said color in the machine color table;

d) obtaining a firing time associated with the color bar in the firing time table;

e) determining a modified firing time by multiplying said firing time by the percent of color from the pattern color table; and f) repeating steps (a), (b), (c), (d), and (e) for all colors and percent of colors associated with each pixel code in the pattern color table.

3. A method according to claim 2 wherein the step of generating a firing time table comprises the steps of:

a) accessing a base file associated with the base entry in the list of entries, said base file containing the firing time data for each color bar in the system with respect to the given pattern; and b) compiling the firing time table by associating each color bar in the system with the firing time data.

4. A method according to claim 3 wherein the step of generating a machine color table comprises the steps of:

a) reading the color loading entries to determine the color data for each of the color bars in the system;

b) compiling the machine color table by associating each color data with the color bar loaded with that particular color.

5. A method according to claim 4 wherein the step of generating a pattern color table comprises the steps of:

a) accessing a stock file associated with the stock entry in the list of entries, said stock file containing the pixel codes associated with the given pattern in the stock file and the colors associated with each of the pixel codes; and b) compiling the pattern color table associating each pixel code with its respective colors from the stock file.

6. A method according to claim 5 wherein the step of entering a list of entries is carried out by an operator, the operator entering entries corresponding to the given base, stock file and machine color loading for producing a required pattern.

7. A method for automatically loading a plurality of look-up tables with firing time data for a requested pattern, the method comprising the steps of:

a) operating a textile dyeing system, including a plurality of color bars having a plurality of dye jets, each one of the look-up tables being uniquely associated with one of the color bars, to pattern a substrate moved into operative range of said color bars;

b) entering a list of entries including a base entry, machine color loading entries and a stock entry into the textile dyeing system;

c) accessing a base file associated with the base entry in the list of entries, said base file containing the firing time data for each color bar in the system with respect to the given pattern;

d) compiling a firing time table by associating each color bar in the system with the firing time data;

e) reading the color loading entries to determine the color data for each of the color bars in the system;

f) compiling a machine color table by associating each color data with the color bar loaded with tha particular color;

g) accessing a stock file associated with the stock entry in the list of entries, said stock file containing pixel codes associated with the given pattern in the stock file and the colors associated with each of the pixel codes;

h) compiling a pattern color table associating each pixel code with its respective colors from the stock file;

i) obtaining a pixel code from the pattern color table and associating said pixel code with a color and percent of color from the pattern color table;

j) obtaining a color bar associated with said color in the machine color table and obtaining a firing time associated with the color bar in the firing time table;

k) determining a modified firing time by multiplying said firing time by the percent of color from the pattern color table;

l) repeating steps (a), (b), (c), (d), (e), (f), (g), (h), (i), (j) and (k) for all colors and percent of colors associated with each pixel code in the pattern color table;

m) loading said look-up tables with the modified firing time data for each pixel code for each color bar, said look-up tables defining the firing times for each dye jet in each color bar for the requested pattern.

8. A method according to claim 7 wherein the step of entering is carried out by an operator entering entries corresponding to a given base, stock file and machine color loading for providing the requested pattern.

9. An apparatus for automatically loading at least one look-up table in a textile dyeing apparatus with firing time data, comprising:

a plurality of color bars arranged in operative range along the path of a substrate;

a plurality of individual dye applicators arranged in spaced relation across each of said color bars, the dye applicators being capable of selectively projecting a stream of dye onto a predetermined portion of the substrate;

a processor system coupled to the textile dyeing apparatus for processing a requested pattern;

means for entering a list of entries including a base entry, machine color loading entries and stock entry into the processor system;

means for generating a firing time table of firing times, for each of a plurality of color bars with respect to a given base from the base entry;

means for generating a machine color table of color data for each of the plurality of color bars from the machine color loading entries;

means for generating a pattern color table of pixel codes and their associated colors with respect to a given pattern from the stock entry;

means for correlating said firing times, color data and pixel codes to obtain a modified firing time for each pixel code for each color bar; and means for loading said look-up table with the modified firing time data for each pixel code for each color bar.

10. An apparatus according to claim 9 wherein the means for correlating comprises:

a) means for obtaining a pixel code from the pattern color table;

b) means for associating said pixel code with a color and percent of color from the pattern color table;

c) means for obtaining a color bar associated with said color in the machine color table;

d) means for obtaining a firing time associated with the color bar in the firing time table; and e) means for determining a modified firing time by multiplying said firing time by the percent of color from the pattern color table.

11. An apparatus according to claim 9 wherein the means for generating a firing time table comprises:

a) means for accessing a base file associated with the base entry in the list of entries, said base file containing the firing time data for each color bar in the system with respect to the given pattern; and b) means for compiling a firing time table by associating each color bar in the system with the firing time data.

12. An apparatus according to claim 9 wherein the means for generating a machine color table comprises:

a) means for reading the color loading entries to determine the color data for each of the color bars in the system; and b) means for compiling a machine color table by associating each color data with the color bar loaded with that particular color.

13. An apparatus according to claim 9 wherein the means for generating a pattern color table comprises:

a) means for accessing a stock file associated with the stock entry in the list of entries, said stock file containing the pixel codes associated with the given pattern in the stock file and the colors associated with each of the pixel codes; and b) means for compiling a pattern color table associating each pixel code with its respective colors from the stock file.

14. The apparatus according to claim 9, further comprising a dye manifold assembly extending across said substrate, said manifold including said color bars.

15. The apparatus according to claim 14, further comprising a reservoir tank for containing liquid dye, said tank being in fluid communication with said manifold assembly.

16. The apparatus according to claim 15, further comprising actuators for actuating said dye applicators to selectively project a stream of dye on to a predetermined portion of the substrate, said actuators including air deflectors for each dye applicator controlled by a valve, said means for correlating said firing times, color data and pixel codes to obtain a modified firing time for each pixel code for each color bar cooperating with air deflectors to interrupt air flow depending on pattern information received.

17. The apparatus according to claim 16, wherein each valve is of the electromagnetic solenoid type operated by an electrical signal.

18. The apparatus according to claim 17, wherein said means for determining a modified firing time by multiplying said firing time by the percent of color from the pattern color is electrically connected to said solenoid to deliver an electrical signal thereto corresponding to said modified firing time.

19. The apparatus according to claim 18, wherein said applicators include an array of dye jets, and said air deflectors are arranged to continuously deliver air across said dye jets to deflect dye away from the substrate.

20. The apparatus according to claim 19, wherein said substrate is moved along a continuous path, and further comprising a sensor for sensing movement of said substrate, said sensor being integrated with said means for determining the modified firing times for adjusting the firing time to accommodate movement of said substrate.

21. The apparatus according to claim 20, wherein said processor system includes a real time computer, a host computer, and wherein said means for entering a list of entries include a terminal having input keys.

22. The apparatus according to claim 21, wherein said computer includes means for providing instructions to retrieve an SKU file and a base file with the required pattern information.

23. The apparatus according to claim 22, wherein said computer includes a source for storing pattern data, said host computer having means for fetching said pattern data from said source.

24. The apparatus according to claim 23, wherein said source for pattern data is a pattern computer.

25. The apparatus according to claim 24, wherein said plurality of color bars includes eight color bars with each color bar having over 100 dye jets.

26. The apparatus according to claim 25, further comprising a real time computer for ensuring that raw source pattern data is properly output to the pattern control system.

27. The apparatus according to claim 26, wherein said means for sensing the movement of said substrate is a rotary motion transducer electrically connected to said pattern control system.

28. A computer base method for dying textiles by automatically loading at least one look-up table in a textile dyeing system with firing time data, the method comprising the steps of:

(a) entering into a computer data base a list of entries including a base entry, machine color loading entries and a stock entry;

(b) generating a firing time table of firing times, for each of a plurality of color bars with respect to a given base, from the base entry;

(c) generating a machine color table of color data for each of the plurality of color bars from the machine color loading entries;

(d) generating a pattern color table of pixel codes and their associated colors with respect to a given pattern from the stock entry;

(e) correlating said firing times, color data and pixel codes to obtain a modified firing time for each pixel code for each color bar;

(f) loading said look-up table with the modified firing time data for each pixel code for each color bar;

(g) arranging a plurality of color bars each bar with its respective dye jets along a path of a textile substrate;

(h) moving a textile substrate along said path; and (i) actuating said dye jets by firing times according to the data configured by said look-up table.

29. A method according to claim 28 wherein the step of correlating comprises the steps of:

(a) obtaining a pixel code from the pattern color table;

(b) associating said pixel code with a color and percent of color from the pattern color table;

(c) obtaining a color bar associated with said color in the machine color table;

(d) obtaining a firing time associated with the color bar in the firing time table;

(e) determining a modified firing time by multiplying said firing time by the percent of color from the pattern color table; and (g) repeating steps (a), (b), (c), (d), and (e) for all colors and percent of colors associated with each pixel code in the pattern color table.

* * * * *

UNITED STATES PATENT AND TRADEMARK OFFICE

CERTIFICATE OF CORRECTION

PATENT NO. : 5,195,043

DATED : March 16, 1993

INVENTOR(S) : George C. Varner

It is certified that error appears in the above-identified patent and that said Letters Patent is hereby corrected as shown below:

Claim 1, Column 10, Line 49 should read as follows:

a) entering a list of entries including a base entry, machine color loading entries and a stock entry into the system.

Claim 9, Column 12, Line 30 should read as follows:

9. An apparatus for automatically loading at least one look-up table in a textile apparatus machine with firing time data, comprising:

Signed and Sealed this

First Day of March, 1994

Bruce Lehman

*Attest:*

BRUCE LEHMAN

*Attesting Officer*

*Commissioner of Patents and Trademarks*